US012728314B2

(12) United States Patent
Clearwater

(10) Patent No.: US 12,728,314 B2
(45) Date of Patent: Sep. 8, 2026

(54) SYSTEMS AND METHODS FOR CREATING A PLAYER SWING SCORE AND CREATING TRAINING RECOMMENDATIONS ACCORDINGLY

(71) Applicant: GOLFTEC ENTERPRISES LLC, Englewood, CO (US)

(72) Inventor: Nick Clearwater, Englewood, CO (US)

(73) Assignee: GOLFTEC ENTERPRISES LLC, Englewood, CO (US)

( * ) Notice: Subject to any disclaimer, the term of this patent is extended or adjusted under 35 U.S.C. 154(b) by 276 days.

(21) Appl. No.: 18/398,486

(22) Filed: Dec. 28, 2023

(65) Prior Publication Data

US 2025/0213918 A1 Jul. 3, 2025

(51) Int. Cl.

| | |
|---|---|
| ***A63B 24/00*** | (2006.01) |
| ***A63B 71/06*** | (2006.01) |
| ***A63B 102/32*** | (2015.01) |

(52) U.S. Cl.

CPC ..... *A63B 24/0003* (2013.01); *A63B 71/0622* (2013.01); *A63B 2071/0694* (2013.01); *A63B 2102/32* (2015.10); *A63B 2220/05* (2013.01); *A63B 2220/807* (2013.01); *A63B 2220/89* (2013.01)

(58) Field of Classification Search

None

See application file for complete search history.

(56) References Cited

U.S. PATENT DOCUMENTS

| | | | | |
|---|---|---|---|---|
| 9,855,482 | B1 * | 1/2018 | Dickinson | A63B 69/0057 |
| 11,583,729 | B2 * | 2/2023 | Beach | A63B 69/3605 |
| 2022/0219044 | A1 * | 7/2022 | Beach | A63B 69/3605 |
| 2024/0261648 | A1 * | 8/2024 | Timms | A63B 60/46 |
| 2025/0195977 | A1 * | 6/2025 | Edmonson | A63B 69/3632 |

* cited by examiner

*Primary Examiner* — Ronald Laneau

(74) *Attorney, Agent, or Firm* — Haynes and Boone, LLP

(57) ABSTRACT

In one embodiment, a method for training a golfer and providing a Swingscore includes, tabulating a plurality of model player data sets for a plurality of clubs to create a tabulated plurality of model player sets. The method further including capturing a user player data set for a plurality of clubs. The method further including comparing the user player data set of the plurality of model player data sets. The method further including determining a Swingscore based on the comparison. In one configuration, the Swingscore is determined by comparing two positions of a set of ten positions of the user player data set to corresponding two positions of the tabulated plurality of model player data sets.

18 Claims, 9 Drawing Sheets

P1 - Address

P2 - Takeaway

P3 - Backswing

P4 - Top of Swing

P10 - Finish

P9 - Release (b)

SYSTEMS AND METHODS FOR CREATING A PLAYER SWING SCORE AND CREATING TRAINING RECOMMENDATIONS ACCORDINGLY

BACKGROUND

In various scenarios, users may desire to measure their performance against other individuals playing a sport. A common sport for comparison, that provides ready results is golf. Players may compare their shots to those that the pros take and may view, in some scenarios, that shots that professional golfers took and what their resulting score was. However, in the abstract, these comparisons may be lacking and not provide for training and avenues for improvement for the typical golfer.

SUMMARY

In one embodiment, a method for training a golfer and providing a Swingscore includes, tabulating a plurality of model player data sets for a plurality of clubs to create a tabulated plurality of model player sets. The method further including capturing a user player data set for a plurality of clubs. The method further including comparing the user player data set of the plurality of model player data sets. The method further including determining a Swingscore based on the comparison. In one configuration, the Swingscore is determined by comparing two positions of a set of ten positions of the user player data set to corresponding two positions of the tabulated plurality of model player data sets. In another configuration the Swingscore is determined by comparing three positions of a set of ten positions of the user player data set to corresponding three positions of the tabulated plurality of model player data sets.

In one embodiment, a system for determining a Swingscore, includes a launch monitor, the launch monitor capturing club characteristics of a golf club swung by a user. The system further includes a Swingscore module, the Swingscore module determining a Swingscore based on the club characteristics. The system further includes a display module, the display module displaying the Swingscore to the user. Alternatively, the launch monitor captures the club characteristics in at least on of positions P1-P10. In one alternative, the positions P1-P10 include P1—the Address; P2—the Takeaway, P3—Backswing, P4—Top of Swing, P5—the Downswing (or transition), P6—Preimpact—the club position prior to impact, P7—Impact, P8—Release, P9, P10—Finish—final position of the club. In another alternative, the Swingscore module only utilizes positions P4-P7. Alternatively, the display module indicates a color, the color indicative of the Swingscore. In one alternative, the Swingscore is calculated on a basis of a velocity of the club. In another alternative, the Swingscore is calculated on a basis of a height of the club. Alternatively, Swingscore is calculated on a basis of a position of the face of the club. In another alternative, the display module provides an indication of an increase in the Swingscore based on an increase in the velocity of the club. Alternatively, the display module provides an indication of an increase in the Swingscore based on a correction to the height of the club. In another alternative, the display module provides an indication of an increase in the Swingscore based on a correction to the position of the face of the club.

In one embodiment, a method for determining a Swingscore, includes capturing club characteristics of a golf club swung by a user at a launch monitor. The method further includes determining a Swingscore based on the club characteristics at a Swingscore module. The method further includes displaying the Swingscore to the user at a display module. Alternatively, the launch monitor captures the club characteristics in at least on of positions P1-P10. In one alternative, positions P1-P10 include P1—the Address; P2—the Takeaway, P3—Backswing, P4—Top of Swing, P5—the Downswing (or transition), P6—Preimpact—the club position prior to impact, P7—Impact, P8—Release, P9, P10—Finish-final position of the club. In another alternative, Swingscore module only utilizes positions P4-P7. Alternatively, the method further includes comprising displaying a color indicative of the Swingscore with the display module. Alternatively, the Swingscore is calculated on a basis of a velocity of the club. In another alternative, Swingscore is calculated on a basis of a height of the club. Alternatively, the Swingscore is calculated on a basis of a position of the face of the club. In another alternative, the display module provides an indication of an increase in the Swingscore based on an increase in the velocity of the club. Alternatively, the display module provides an indication of an increase in the Swingscore based on a correction to the height of the club.

DETAILED DESCRIPTION

Figure 1:
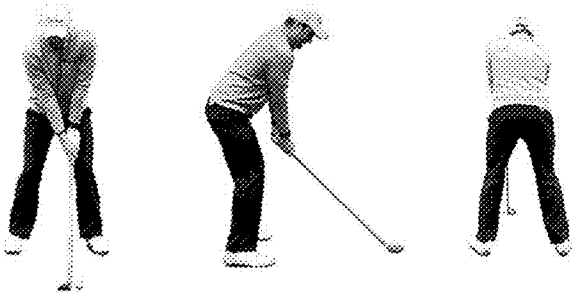
FIGS. 1-10 show one embodiment of diagrams of the ten swing positions
Figure 2:
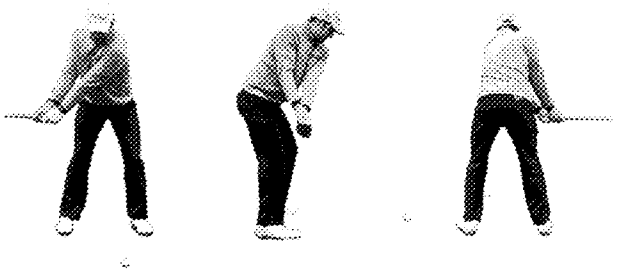
Figure 3:
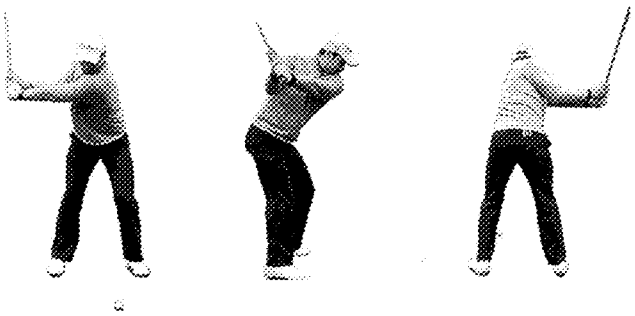
Figure 4:
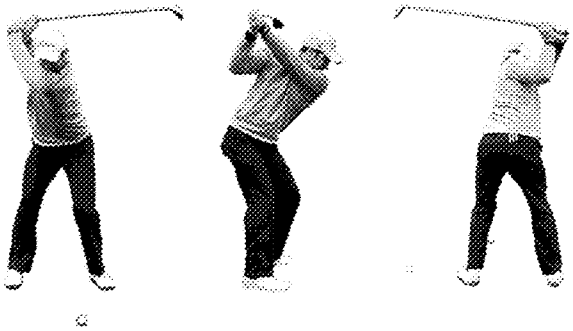
Figure 5:
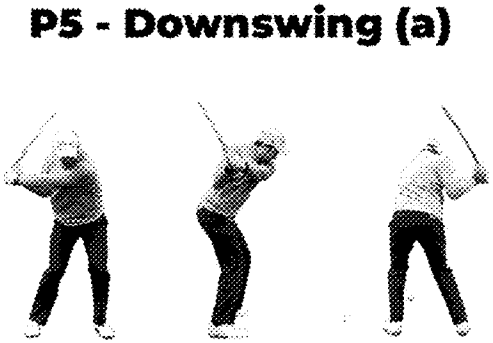
Figure 6:
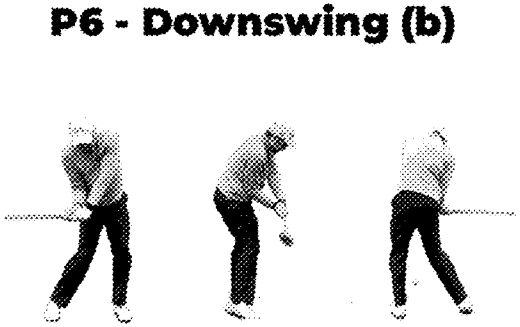
Figure 7:
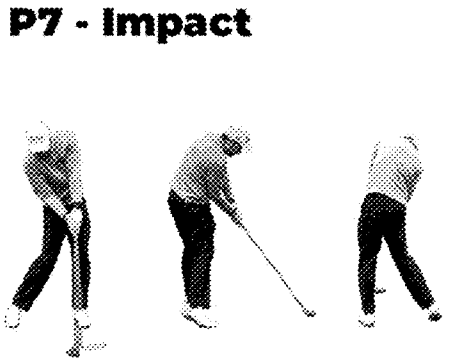
Figure 8:
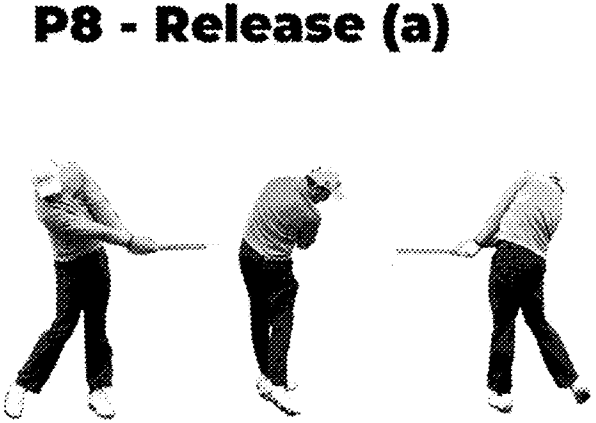
Figure 10:
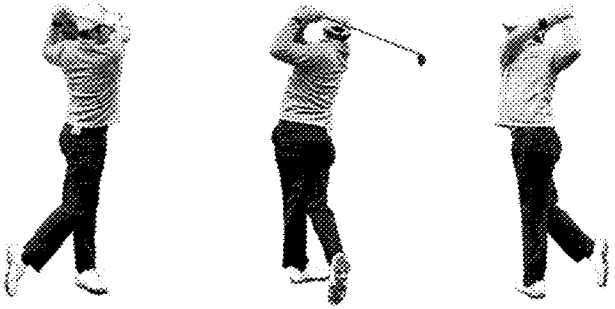
Figure 9:
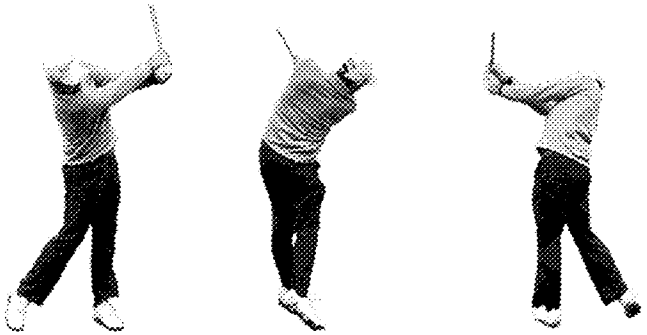

Certain terminology is used herein for convenience only and is not to be taken as a limitation on the embodiments of the Systems and Methods of creating a player swingscore and corresponding training plan. In many configurations, there are multiple positions of player swing monitored and recorded. In many configurations, there are considered to be ten positions for a golf swing. In various alternatives, more or fewer positions may be considered, monitored, and recorded by the Swingscore system. Additionally, even if information on the various positions are captured, only a subset of the positions may be used by the Swingscore system in calculating a Swingscore and providing an improvement plan. Generally, the ten positions include:

1. P1—the Address—club position when the player sets up and starts the swing;
2. P2—the Takeaway—club position when the shaft of the club is approximately parallel to the ground;
3. P3—Backswing—the club position with the arms of the golfer are approximately parallel to the ground;
4. P4—Top of Swing—the club position when the club reaches the furthest point of the backswing;
5. P5—the Downswing (or transition)—the club position as the energy of the backswing begins to be released;

6. P6—Preimpact—the club position prior to impact, typically when the arms of the golfer are approximately parallel to the ground;
7. P7—Impact—when the club strikes the ball;
8. P8—Release—the club position when the club is approximately parallel to the ground after impact;
9. P9—Follow-through—club position after release, prior to finish;
10. P10—Finish—final position of the club. (See FIGS. 1-10)

Throughout this disclosure, the various positions may be referred to by their "P number". For instance, in many configurations, the Swingscore is calculated based on P4 and P7 and the characteristics of the swing in those positions. Primary characteristics of concern may include the velocity of the club, the height of the club, the position of the face of the club, and other characteristics. These characteristics, as well as characteristics concerning the ball or body position of the user may be used in the calculation of a Swingscore.

In one method of calculating a Swingscore, position P4 location and position P7 velocity are compared to a data set consisting of model player swings, that include position P1-P10. A variance from a model player swing is calculated for the various positions. In one alternative, a user may select a pro-golfer or swing model to be compared against. In many embodiments, the variance may be communicated via a colored indicator, such as a red, yellow, and green, indicating how close the swing was to the model player swing.

In many embodiments, variance on any position P1-P10 may be compared against other players in a database that have similar variance on any position. A predicted handicap may be created by comparing against similar players. Additionally, a predicted handicap improvement or Swingscore improvement is generated in some embodiments. The predicted improvement provides the user an indication of how much their handicap is likely to improve if a particular position of a swing is improved.

Figure 11:
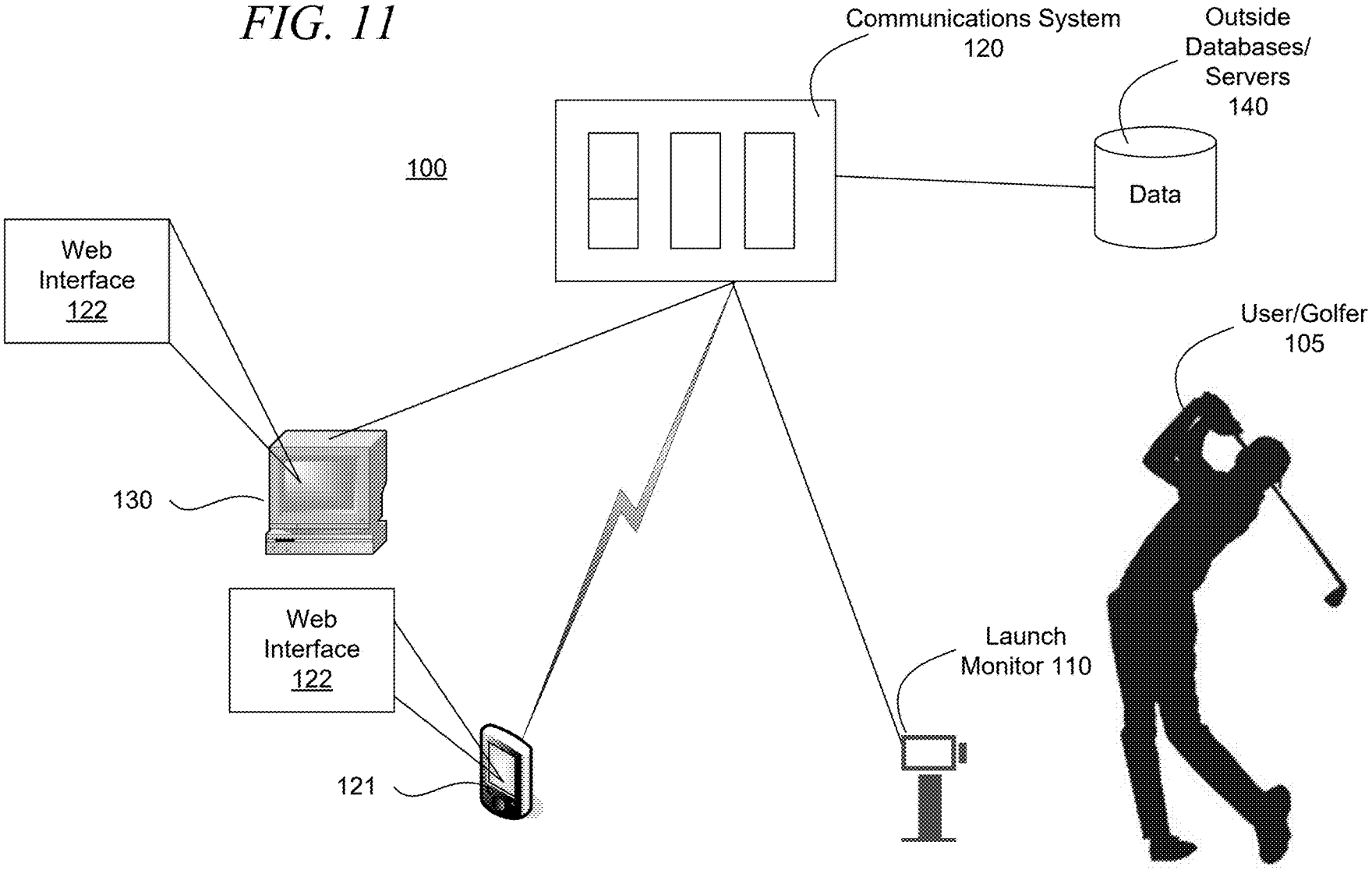
FIG. 11 shows one embodiment of a system for calculating trajectories.

FIG. 11 shows one embodiment of a system 100 for calculating trajectories. System 100 includes one or more launch monitors 110. Launch monitors 110 track the swing trajectory and/or the ball trajectory created by golfer 105 when a ball is struck. Launch monitor 110 may communicate via wired or wireless communication with communications system 120, typically a wired, wifi, or Bluetooth system, however various other communications protocols may be used. Communications system 120 may communicate with computer 130, which may have a web interface 122 or other user interface including customized GUIs and other interfaces used in sports computing systems. Alternatively, communications system 120 may communicate with mobile device 121, which may be a smart phone, tablet, or other mobile device. Communications system 120 in many configurations communicates with remote resources, such as servers or databases 140, which provide for more powerful trajectory calculation systems, simulation systems, or databases of comparable players (including videos, images, or swing movies) or other information. In some alternatives, launch monitor 110 may be directly wired to computer 130 or communicate directly with mobile device 121. Numerous possibilities and alternative configurations exist, within typical device setup.

In many embodiments, the user 105 executes multiple swings that are captured by launch monitor 110. These swings are recorded and multiple frames are captured reflective of the positions P1-P10. Captures of these positions are presented to the user on computer 130 or mobile device 121 in many configurations. Additionally, characteristics of the swing of user 105 at each positions P1-P10 are calculated, typically including velocity and angle. Calculations and generation of position may occur at the launch monitor 110, at the mobile device, at the computer 130, at the communications system 120 which typically includes enterprise software providing for analysis or some combination thereof including one or more devices. Additionally, outside databases 140 may be accessed to provide the user 105 a side by side of their swing position at positions P1-P10 and an ideal position. The side by side images may include actual real life images of the ideal swing and the golfer swing or computer generated images. The computer 120 and the mobile device 121 may access information via a web interface.

Additionally, swing score or handicap may be calculated at the launch monitor 110, at the mobile device, at the computer 130, at the communications system 120 which typically includes enterprise software providing for analysis or some combination thereof including one or more devices. In some embodiments, the Swingscore is calculated for each positions P1-P10. In some embodiments, the Swingscore is an average for each positions P1-P10. In some alternatives, the Swingscore may be calculated on a club basis, with different scores being calculated for wedges, each iron, and each driver, etc. In one embodiment, a Swingscore is calculated by taking the percentage difference between the velocity of the swing of a user at one or more position P1-P10 and averaging the difference. In another embodiment, the Swingscore is calculated by taking the percentage difference between the angle to the ground of the swing of a user at one or more position P1-P10 and averaging the difference. In another embodiment, the Swingscore is calculated by taking the percentage difference between the angle to the ground and the velocity of the swing of a user at one or more position P1-P10 and averaging the difference. In another embodiment, the Swingscore is calculated by taking the percentage difference between the angle to the ground and the velocity and one or more additional variables of the swing of a user at one or more position P1-P10 and averaging the difference. Additional variables include by are not limited to the club face angle, the hip turn, the arm straightness, and other variables. Additionally, in many embodiments, the Swingscore may be correlated to handicap, by accessing records of golfers with similar Swingscores and returning an average or regression analysis of their handicap.

Figure 12:
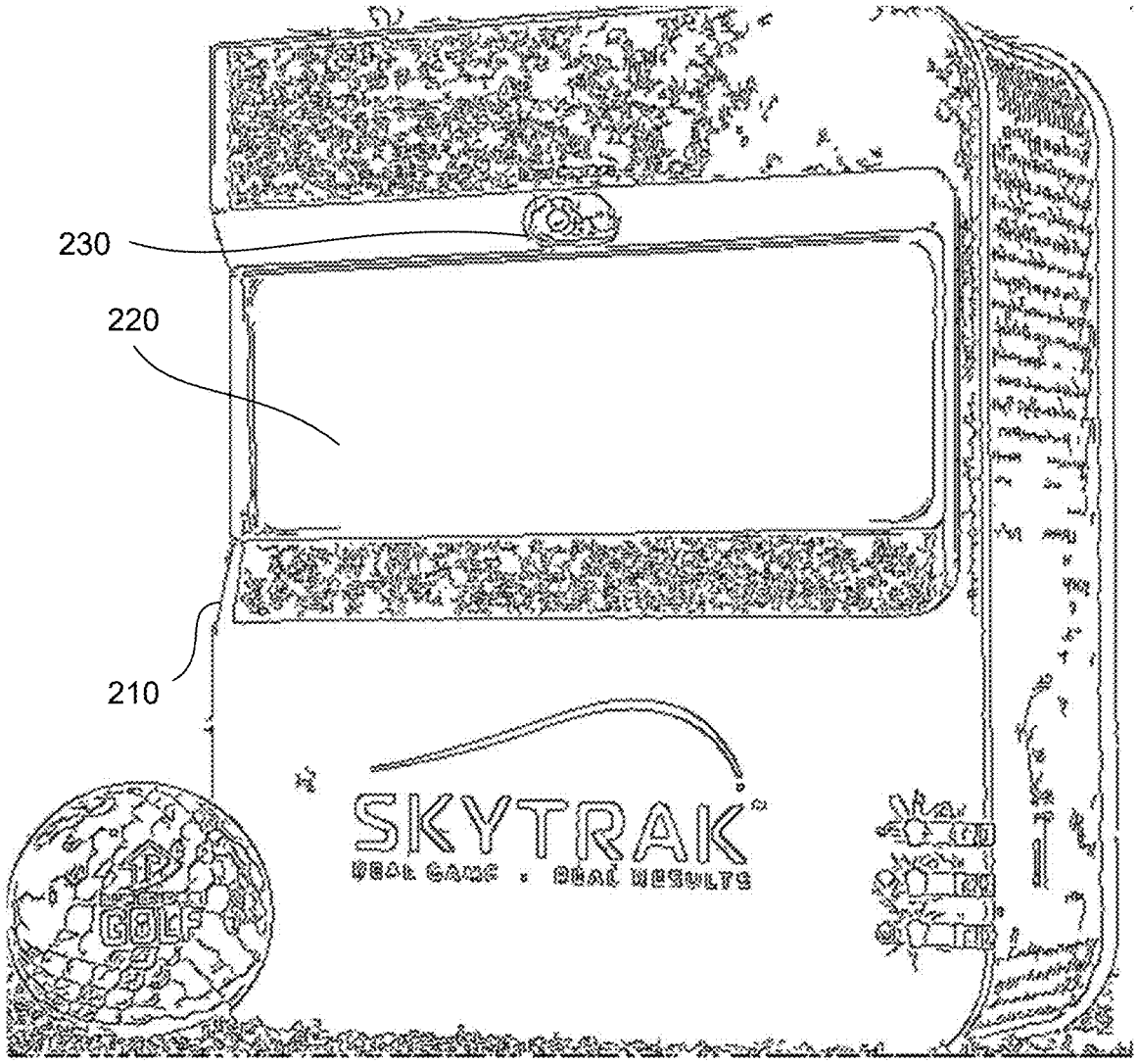
FIG. 12 shows one embodiment of a launch monitor.

FIG. 12 shows one embodiment of a launch monitor 210 (corresponds to launch monitor 110 in FIG. 1). Launch monitor 210 includes an optical sensing system 220, that may include one or more cameras for tracking the trajectory of a ball and/or club. Launch monitor 210 also includes radar sensing system 230 for tracking the trajectory of a ball and/or club. Launch monitor 210 may in some alternatives, include only one of optical sensing system 220 and radar sensing system 230. Launch monitor 210 includes a processor and communication system for processing raw data recording into a form that is easily transmitted and processed by another computing device. In many embodiments, launch monitor 210 may capture images of the golfer, in order to display the images for the golfer.

Figure 13:
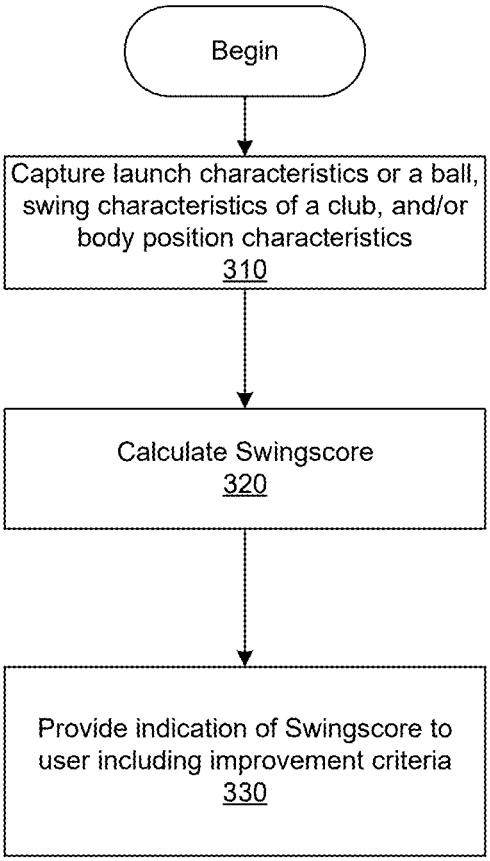
FIG. 13 shows a flow chart for one embodiment of a method for determining the trajectory of a sports object.

FIG. 13 shows a flow chart for one embodiment of a method involving Swingscores. In step 310, a launch monitor may capture launch characteristics or a ball, swing characteristics of a club, and/or body position characteristics. A Swingscore may be calculated based on the ball characteristics, the swing characteristics of the club, and the body position of the user and combinations thereof. In step 320, the system calculates the Swingscore. In more complex configurations, the Swingscore may be calculated by combining multiple swings and/or may be calculated on a per club basis. In step 330, the user is provided an indication of what the their Swingscore is. This may merely by a numerical indication or may be a color indication of green if within 90% of ideal, yellow if within 60% of ideal, or red if below 60% (other percentages may be used as well). Additionally, the Swingscore may indicate if it is the swing angle, speed, or some other characteristic that needs to be improved to reach a better Swingscore. In step 330, images displaying the user's swing and improved or professional swing may be provided.

In many embodiments, a score is calculated. One exemplary method of calculating a swing score includes using the percentage difference from an ideal swing. In many configurations, this is determined based on the translation and rotational kinematic points of the user and the invisible forces and torques applied. For example, a position P5, the kinematics of the individual may be measured and compared to ideal, which may, for example include that the shoulders are closed by 30 degrees and tilted at a certain angle. Then the degree of difference may be determined. Further, the degree of difference at each of the points may be determined. A score out of some metric (such as a 1000 points) may be used to deliver the Swingscore. One such method would be to assign 100 points to each swing position and to aware 100 points if the position measured was a match and 1 less point for each percentage difference.

In alternatives, kinetic measures may be used alone or in addition to the kinematic points. In this context, kinetics generally refers to the speed and direction of the club and kinematics refers to the position of the user's body. In some embodiments the Swingscore is determined according to kinetics. In other embodiments, the Swingscore is determined according to kinematics. In some embodiments, the Swingscore is determined according to both kinematics and kinetics and sometimes weighted to favor one over the other.

In some alternatives, Keypoint relationships are utilized. Such a keypoint relationship includes the positional arrangement of the trailing wrist to the leading shoulder. In such a scenario, similar to the above, the percentage difference from the ideal keypoint relationship may be utilized to determine the Swingscore.

In some embodiments, club mass and physical properties (length, mass of head, center of gravity of the club), club head trajectory and the key points at the grip end of the club, club head speed, and other physical factors are used to modify the Swingscore to the extent they provide a better calculation of the final result.

Essentially, items used to calculate swing score may include 1. Kinematics; 2. Kinetics; 3. User input into the club; 4. Key point relationship; 5. Clubhead trajectory; and 6. The actual or calculated trajectory of the ball.

Figure 14:
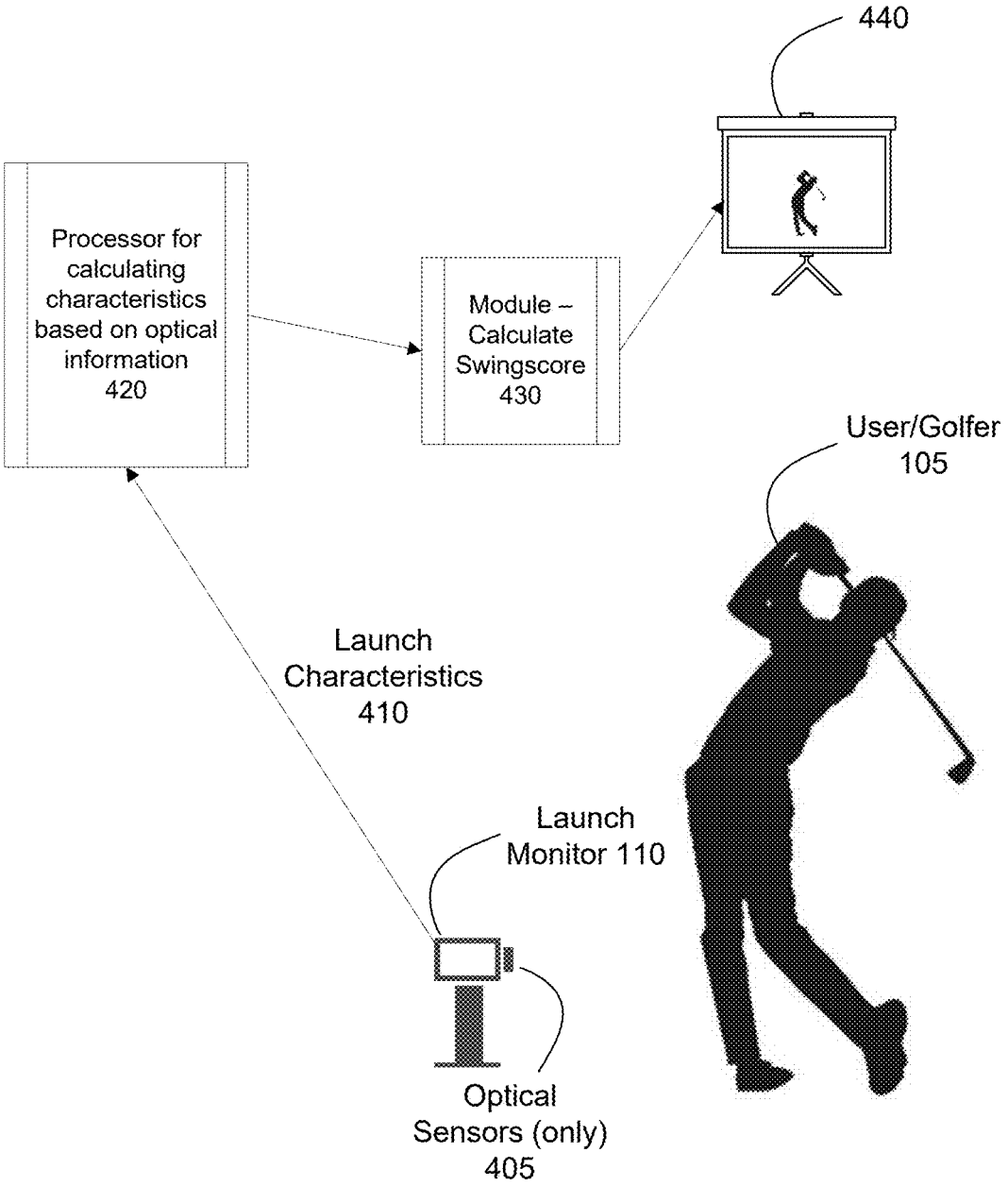
FIG. 14 shows one embodiment a system diagram for a system for calculating a DP Trajectory.

FIG. 14 shows one embodiment a system diagram for a system for calculating a user 105 utilizing a Swingscore system. Here, a user/golfer 105 is monitored by launch monitor 110. Launch monitor 110 may collect information in order to provide a Swingscore. The launch monitor sends launch characteristics 410 of the ball and club (and possibly body position of the user 105) to the processors 420. Processor 430 calculates the Swingscore. At screen 440 the Swingscore may be displayed as well as images of the user's swing and an improved or ideal swing. Indications of corrective action may be provided as well (such as increase swing speed by X feet per second to increase Swingscore to green).

Figure 15:
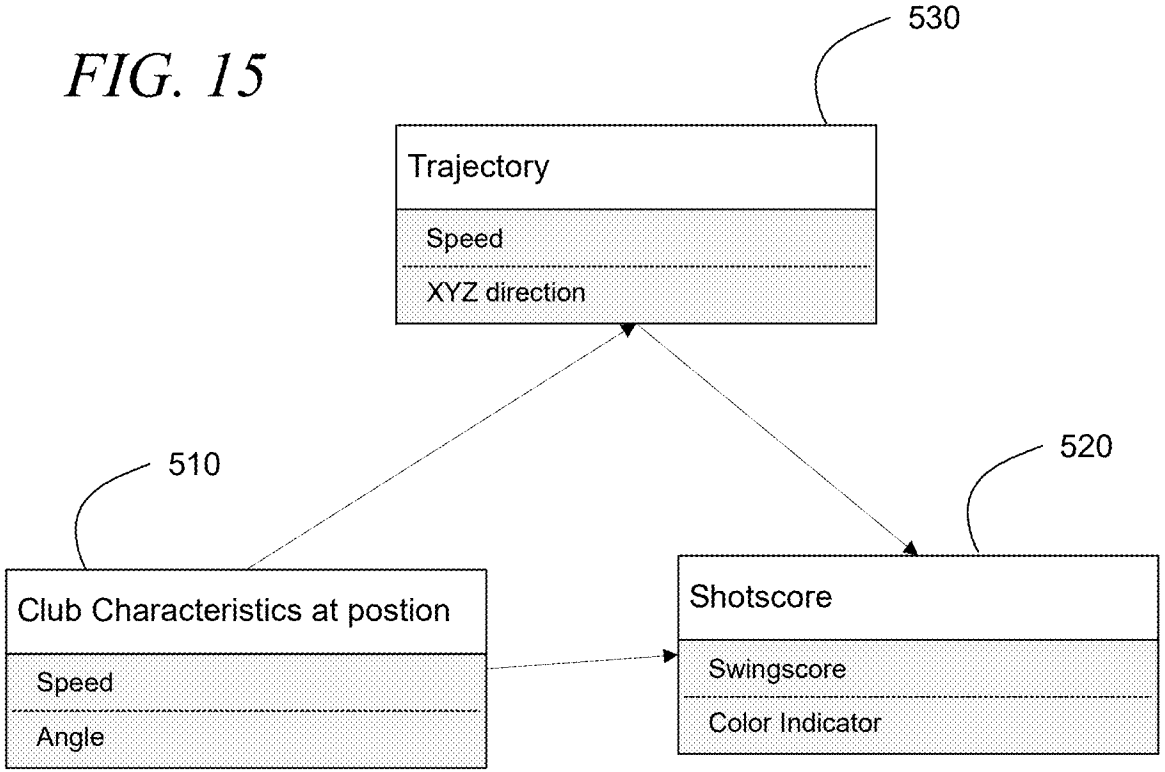
FIG. 15 shows one embodiment of a class diagram for the calculation of a DP Trajectory.

FIG. 15 shows one embodiment of a class diagram for the calculation of a Swingscore. Club Characteristics at a certain position P1-P10 class 510 includes information about the club speed and the angle of the club. These characteristics may inform the trajectory 530 for launch characteristic calculation. Both class 510 and class 530 may inform the Swingscore 520 that provides the user with a Swingscore and a color indicator.

Figure 16:
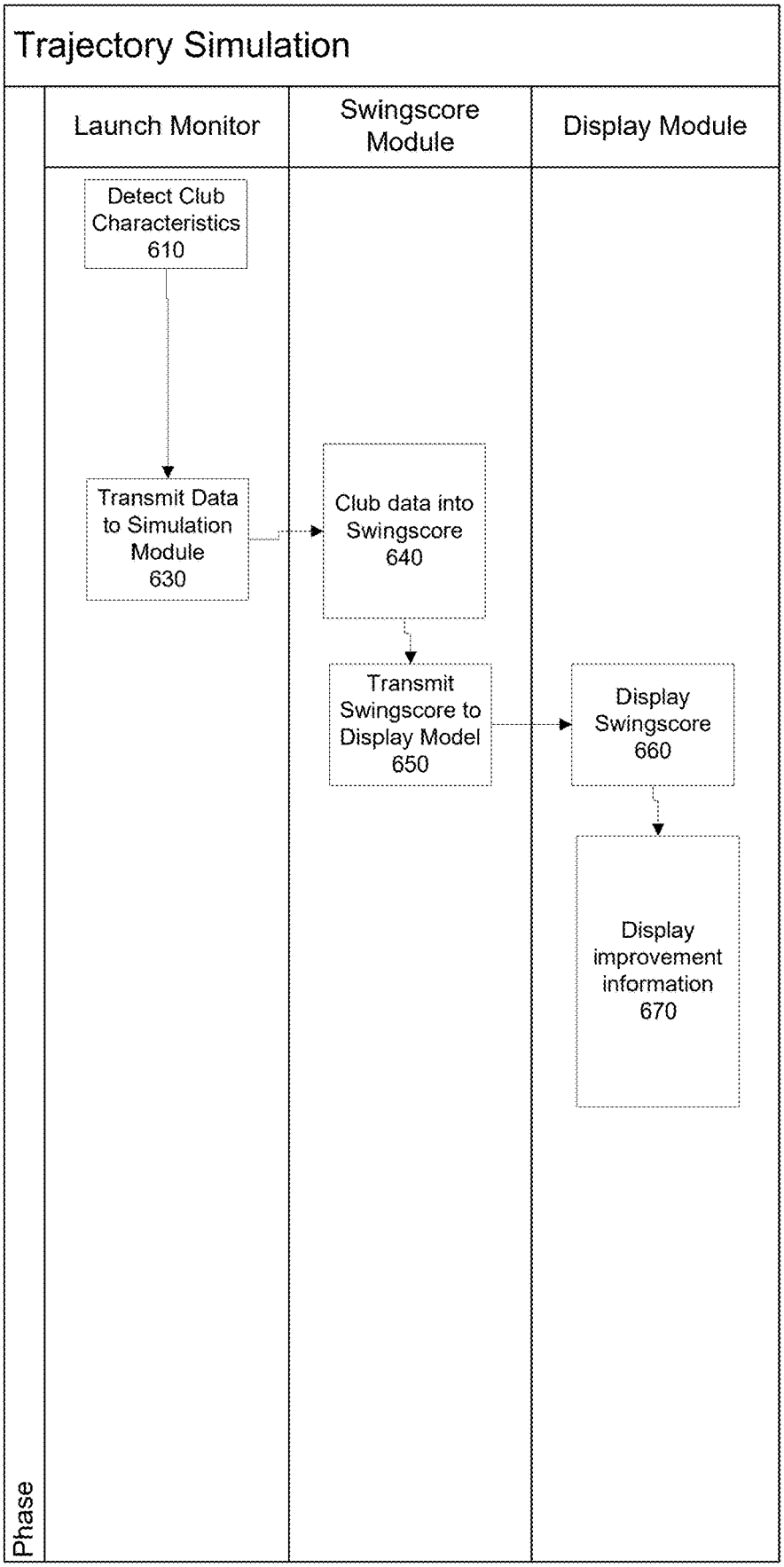
FIG. 16 provides one embodiment of a swimlane diagram for a DP Trajectory System.

FIG. 16 provides one embodiment of a swimlane diagram for a calculating a Swingscore. Here, the launch monitor detects club characteristics (and possible ball and body position characteristics as well as images of the user) in step 610. In step 630 this is transmitted to the Swingscore module. In step 640, the Swingscore module coverts the club data (and/or additional data) to a Swingscore according to one or more of the techniques described herein. In step 650, data is transmitted to the Display Module. The Display Module then displays the Swingscore to the user in step 660. Additionally, the Display Module may display corrective/improvement information suggesting changes to the user's swing and/or displaying ideal swings in step 670.

In many embodiments, parts of the system are provided in devices including microprocessors. Various embodiments of the systems and methods described herein may be implemented fully or partially in software and/or firmware. This software and/or firmware may take the form of instructions contained in or on a non-transitory computer-readable storage medium. Those instructions then may be read and executed by one or more processors to enable performance of the operations described herein. The instructions may be in any suitable form such as, but not limited to, source code, compiled code, interpreted code, executable code, static code, dynamic code, and the like. Such a computer-readable medium may include any tangible non-transitory medium for storing information in a form readable by one or more computers such as, but not limited to, read only memory (ROM); random access memory (RAM); magnetic disk storage media; optical storage media; a flash memory, etc.

Embodiments of the systems and methods described herein may be implemented in a variety of systems including, but not limited to, smartphones, tablets, laptops, and combinations of computing devices and cloud computing resources. For instance, portions of the operations may occur in one device, and other operations may occur at a remote location, such as a remote server or servers. For instance, the collection of the data may occur at a smartphone, and the data analysis may occur at a server or in a cloud computing resource. Any single computing device or combination of computing devices may execute the methods described.

In various instances, parts of the method may be implemented in modules, subroutines, or other computing structures. In many embodiments, the method and software embodying the method may be recorded on a fixed tangible medium.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

The invention claimed is:

1. A system for determining a Swingscore, the system comprising:

a launch monitor device, the launch monitor device comprising an imaging sensor configured to capture club characteristics of a golf club swung by a user;

a Swingscore module operating on a computing device different from the launch monitor device and in wired or wireless communication with the launch monitor device, the Swingscore module determining a Swingscore based on the club characteristics; and a display module operating on the computing device, the display module displaying the Swingscore to the user, wherein the display module further displays a color indicative of the Swingscore.

2. The system of claim 1, wherein the launch monitor device captures the club characteristics in at least one of positions P1-P10.

3. The system of claim 2, wherein positions P1-P10 include P1—the Address; P2—the Takeaway, P3—Backswing, P4—Top of Swing, P5—the Downswing (or transition), P6—Preimpact—the club position prior to impact, P7—Impact, P8—Release, P9, P10—Finish—final position of the club.

4. The system of claim 3, wherein the Swingscore module only utilizes positions P4-P7.

5. The system of claim 1, wherein the Swingscore is calculated at least partly on a basis of a velocity of the club.

6. The system of claim 5, wherein the Swingscore is calculated at least partly on a basis of a height of the club.

7. The system of claim 6, wherein the Swingscore is calculated at least partly on a basis of a position of a face of the club.

8. The system of claim 7, wherein the display module provides an indication of an increase in the Swingscore based on an increase in the velocity of the club.

9. The system of claim 7, wherein the display module provides an indication of an increase in the Swingscore based on a correction to the height of the club.

10. The system of claim 7, wherein the display module provides an indication of an increase in the Swingscore based on a correction to the position of the face of the club.

11. A method for determining a Swingscore, the method comprising:

with an imaging sensor of a launch monitor device, capturing club characteristics of a golf club swung by a user;

with a Swingscore module operating on a computing device different from the launch monitor device and in wired or wireless communication with the launch monitor device, determining a Swingscore based on the club characteristics;

with a display module operating on the computing device, displaying the Swingscore to the user; and with the display module, displaying a color indicative of the Swingscore.

12. The method of claim 11, wherein the launch monitor device captures the club characteristics in at least one of positions P1-P10.

13. The method of claim 12, wherein positions P1-P10 include P1—the Address; P2—the Takeaway, P3—Backswing, P4—Top of Swing, P5—the Downswing (or transition), P6—Preimpact—the club position prior to impact, P7—Impact, P8—Release, P9, P10—Finish—final position of the club.

14. The method of claim 12, wherein Swingscore module only utilizes positions P4-P7.

15. The method of claim 11, wherein the Swingscore is calculated at least partly on a basis of a velocity of the club.

16. The method of claim 11, wherein the Swingscore is calculated at least partly on a basis of a height of the club.

17. The method of claim 15, wherein the Swingscore is calculated at least partly on a basis of a position of the face of the club.

18. The method of claim 16, wherein the display module provides an indication of an increase in the Swingscore based on an increase in the velocity of the club or a correction to the height of the club.

* * * * *